United States Patent [19]

Rilliet

[11] 4,271,644

[45] Jun. 9, 1981

[54] HALL WITH MOBILE WALL AND ROOF ELEMENTS

[76] Inventor: Philippe Rilliet, Chemin des Fleurettes 47, CH-1007 Lausanne, Switzerland

[21] Appl. No.: 954,922

[22] Filed: Oct. 26, 1978

Related U.S. Application Data

[63] Continuation-in-part of Ser. No. 873,099, Jan. 30, 1978, abandoned.

[30] Foreign Application Priority Data

Feb. 2, 1977 [CH] Switzerland ..... 1234/77

[51] Int. Cl.[3] ..... E04B 1/346

[52] U.S. Cl. ..... 52/67

[58] Field of Search ..... 52/67, 9

[56] References Cited

U.S. PATENT DOCUMENTS

| | | | |
|---|---|---|---|
| 1,896,433 | 2/1933 | Windeknecht | 52/67 |
| 3,248,830 | 5/1966 | Maynard | 52/67 |
| 3,845,591 | 11/1974 | Stine | 52/67 |

FOREIGN PATENT DOCUMENTS

| | | | |
|---|---|---|---|
| 2273917 | 1/1976 | France | 52/67 |
| 1339915 | 12/1973 | United Kingdom | 52/67 |

*Primary Examiner*—Price C. Faw, Jr.
*Assistant Examiner*—Carl D. Friedman
*Attorney, Agent, or Firm*—Saul Jecies

[57] ABSTRACT

A telescopic building and a method of erecting it are disclosed. Ways are provided on a support structure and at least one integral wall and roof element of predetermined height and width is mounted on the support structure. Movable integral wall and roof elements of progressively different height and width are provided at their bases or feet with rollers which track the ways so that they can move to and from a telescopic position of the movable elements.

2 Claims, 7 Drawing Figures

HALL WITH MOBILE WALL AND ROOF ELEMENTS

BACKGROUND OF THE INVENTION

This is a continuation-in-part of my application Ser. No. 873,099, filed Jan. 30, 1978, and now abandoned.

This invention relates to telescopic buildings and a method of erecting the same, especially of those having a large width span.

Conventional telescopic buildings, especially hangars and halls, and their methods of construction, have certain well-known disadvantages, i.e. limitations. These include the fact that if the buildings must span a relatively significant distance without intermediate supports, the whole construction and its supporting structure in particular must be made very strong and correspondingly heavy and such buildings are therefore very costly. The aim of the present invention is to overcome these well-known disadvantages.

SUMMARY OF THE INVENTION

It is an object of the invention to provide a telescopic building which avoids these advantages.

Another object is to provide a method of erecting a building of the type disclosed herein.

Pursuant to these and still further objectives, one aspect of the invention resides in a telescopic building, particularly a hangar, which comprises lateral and intermediate support means; ways on the support means; at least one stationary integral wall and roof element on the support means and having a predetermined height and width; a plurality of movable integral wall and roof elements having a progressively different height and width, all of the movable elements having respective feet; and roller means provided on each foot of the movable elements in rolling engagement with the ways for movement to and from a telescopic position of the movable elements.

The method of erecting such a building may comprise the steps of emplacing lateral and intermediate support means; providing elongated ways on the support means; placing at least one stationary integral wall and roof element of predetermined width and height onto said support means; placing onto the support means a plurality of movable integral wall and roof elements having a progressively different height and width; and supporting the movable elements on the ways via roller means for allowing movement of the roller from and to a telescopic position of the movable elements.

A building according to the invention is especially well suited as a hangar or hall of large size; since the free-spanning portions of the supporting framework, i.e. both the stationary and the movable ones, are born by intermediary supports provided with individual and common supporting rails, so that the framework can be lighter than would otherwise be the case.

The invention will hereafter be described with reference to the accompanying drawings which illustrate the preferred embodiments by way of non-limiting example.

Buildings according to the invention can be used to advantage, as cold-weather shelters, for example, or as shelters against wind, sun, dry air or blowing sand. A particularly attractive aspect is that they can readily be opened up to the atmosphere, ambient conditions permitting, so as to partially or completely expose their floor area and, in effect, to convert the building interior into an "open-air" space. Such buildings can be used, for example, as sports halls (e.g. for tennis), for industrial applications, for warehousing and sheltering of goods and equipment, be it in summer or in winter.

DESCRIPTION OF PREFERRED EMBODIMENTS

Figure 1:
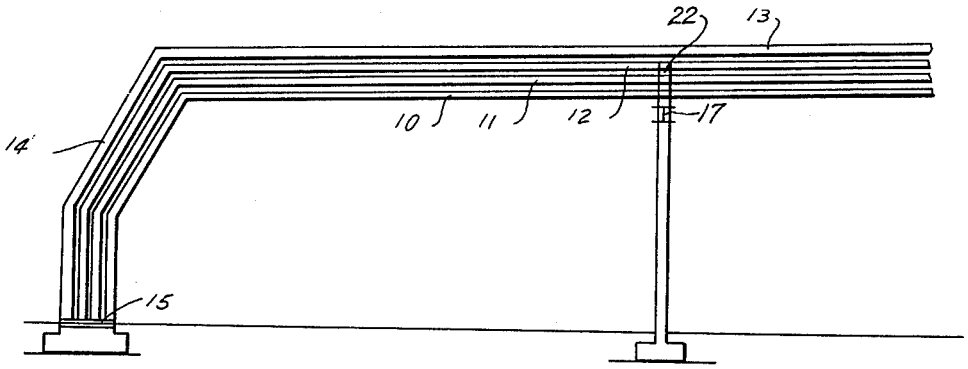
FIG. 1 is a fragmentary transverse vertical section of a hall or hangar composed for four building elements.

Referring firstly to FIGS. 1,2,4 and 5 it will be seen that the fragmentary illustrated building (e.g. a hall or hangar) is composed of a fixed wall and roof element 10 and several (here three) integral mobile wall and roof elements 11, 12 and 13. The fixed element 10 may be of any traditional construction.

The mobile elements, however, are telescopable. Each of these mobile elements 11–13 is constructed as a rigid, self-supporting unit having side walls and a top wall or roof portion. Each element 11–13 is also provided with a pair of discrete supporting frames constituting part of its self-supporting structure. Since the elements 11–13 are to be telescopically interlockable, it is necessary that each frame of an element be offset relative to the supporting frame on the respectively adjoining element.

Each element 11–13 has, as already indicated, a pair of lateral walls; these are designated with reference numeral 14 in the drawings. Each lateral wall 14 in turn has a vertical portion 15. In or beneath the foot ends of these portions 15—or beneath the transverse cross-members connecting the supporting frames of each element 11–13—there are provided rollers or wheels 28 of metal or snythetic plastic material. These are mounted on shafts or pillow blocks, by means of anti-friction (e.g. ball or needle) bearings (not shown). These rollers or wheels roll on or in suitable grooves or rails, depending on the use of the building. The rollers must, of course, be able to run smoothly along the ways formed by the grooves or rails; on the other hand, it is also necessary to take into account other factors. For example, in the determination whether to use grooves or rails and how to locate these, one must take into account e.g. the need to be able to drive vehicles over the ways or to avoid tripping of walkers (as in the case when the building is used to house a swimming pool). Also, aesthetic considerations must be taken into account.

Depending on the type of construction selected, the movable elements 11–13 may be displaced either lengthwise or crosswise to the basic building construction. A particular advantage of the present invention is that the telescopic building need not be either quadratic or rectangular, but that it may instead be circular, semi-circular or even of convex shape.

One of the main inventive aspects of the novel building provides for part of the vertically acting weight to be borne (i.e. sustained) directly by at least one supplementary intermediate supporting device.

Accordingly, and beginning with the second of the respective mobile elements 11–13, the front frame of the previously mentioned pair of frames which is present in each of the elements 11–13, has a vertical supporting link. This is designated with reference numeral 22 in FIG. 2 and serves in particular to bear the front frame and roof structure of the extensible parts of the building. Similar to the front frames, the rear frames of the respective elements are also equipped with rollers positioned beneath these frames and located on the same axis as for the front frame rollers, as considered in the direction of extension and retraction movements of the elements 11–13. These latter rollers support the rear frame and roof structure as the front frame rollers support the front frame and roof structure. The rear frames thus rest on the rail surface mounted on the adjacent roof surface (or surfaces) of all but the largest mobile element (or elements). If the building has a large span, such as a tennis hall may have to span two or more tennis courts (for which applications the invention is especially well suited), then the supporting frames of the mobile elements 11–13 will each include at least one such supplementary intermediate supporting device 22 as heretofore described.

Figure 2:
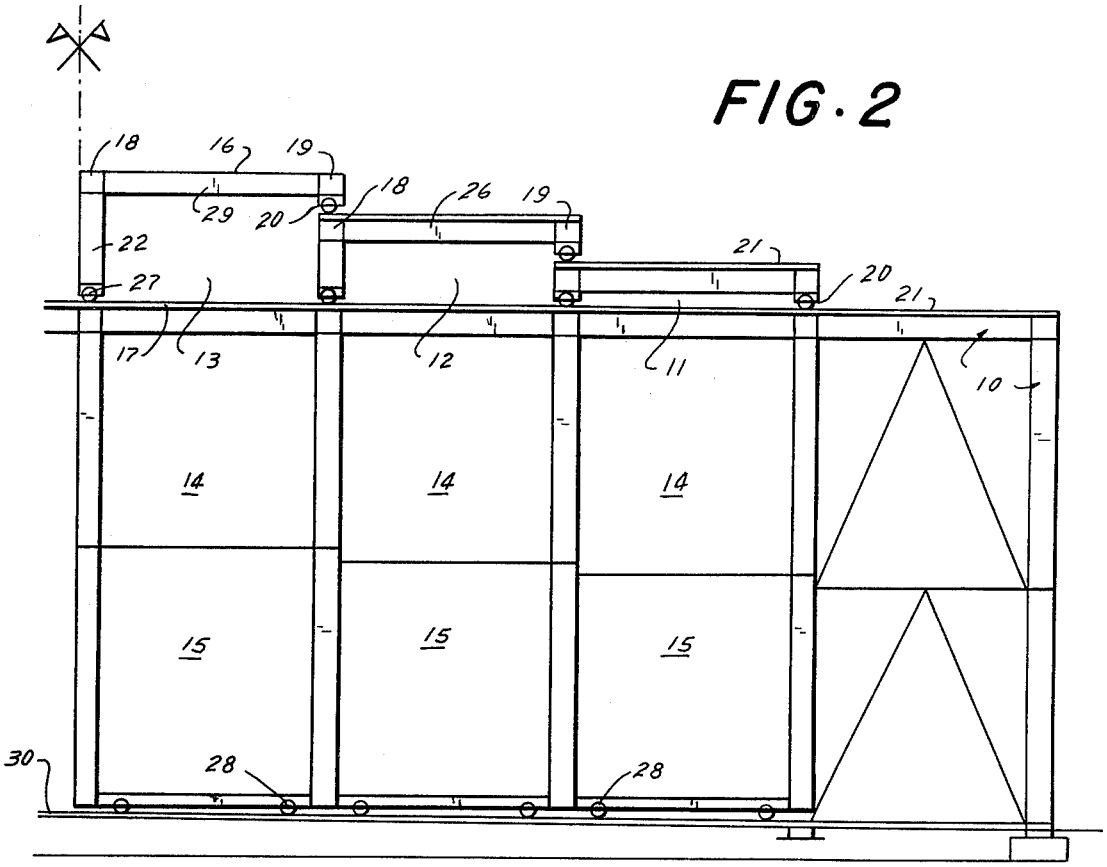
FIG. 2 is a vertical longitudinal section through the building in FIG. 1.
Figure 5:
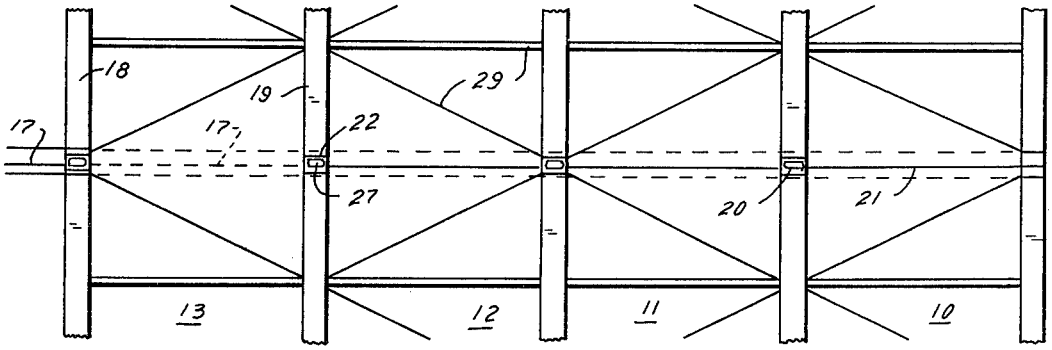
FIG. 5 is a fragmentary aerial view showing the roof structure of a telescopic building according to the invention in extended condition, one intermediate supplementary supporting device, its rails and rollers being shown in partially superposed relationship.

That the integral wall and roof elements 14, 15 and 16 of the movable elements 11–13, respectively, can be moved lengthwise is best shown in FIG. 2 which also shows that the elements 11–13 are partially supported on lateral rails 30 and partially on intermediate common supporting rail (or rails) 17 which is common to the mobile elements of the telescopic building; and further also on roof rails 21. The elements 11–13 can be interlocked with one another. For this purpose each element 14, 15, 16 is composed of a front supporting frame 18 and a rear supporting frame 19 which are connected to each other by cross-braces 29.

Frames 18, 19 have rollers 20, 27 which are mounted on anti-friction bearings (not shown). Rollers 20 roll firstly on a surface of support structure 26 (e.g. frame) on roof rails 21; rollers 27 roll on the rolling surface of the common rail (or rails) 17. The supporting surfaces for the rollers of the rear frames 19 are the rails 21 which are provided, as already mentioned, on all except the largest building elements. The rollersof the rear frames 19 thus roll directly on the immediately subjacent rails 21 which may, of course, be in the form of an actual rail or of a groove. A front roller 27 is always combined with a rear roller 20 and both act in the same axis, as considered in the direction of building element movement.

Since the common rail (or rails) 17, respectively the roof surface of building element 10 which is located so as to form an extension thereof, are usually positioned at a constant height, whereas the roof elements are offset relative to each other and engage below, respectively above one another, the vertical spacing between the respective front frame 18 and the common rail (or rails) 17 varies from one roof element 11–13 to the next. It is for this reason that the supporting link or supplementary intermediate support 22 is required between the front frame 18 and the front roller 27which is located below the same.

The rollers 27 and 20 for the front and rear frames 18, 19 of the smallest of the mobile roof elements 11–13 which is placed directly above the rail or rails 17, are at the same level. However, in each of the larger subsequent mobile roof element differences exist in the levels of the roller axes of the rollers 27 and 20 beneath the front and rear frames of such susequent larger mobile roof elements. When the building is composed of several interlocking telescopic roof elements having the supporting links or supplementary intermediate supports 22 and lower parts equipped with rollers resting directly on the rail or rails 17, then it may in some cases be necessary to construct these links 22 so that they can be made interlockable in such a manner that the roof elements, moved back, will overlap one another to exactly the same extent.

Hangars or other buildings according to the invention are usually laterally supported from beneath with supporting rollers and guide rails. The lateral support components used for this purpose comprise sliding means cooperating with those on the rail or rails 17. The erection of such buildings will have been understood from the preceding description. It will be clear that the rollers, the intermediate supports 22 and the intermediate rail or rails 17 sustain the vertically acting forces. In fact, the lateral support components constituted by the rails 30 and the cooperating rollers 28 serve to guide the combined roof and wall elements 11–13, save for exceptional cases in which lateral guiding components may not be needed. In these exceptional situations the intermediate support 22 may then additionally serve as the guide elements for the mobile roof, or combined roof and wall elements, as shown in the present disclosure.

Figure 3A:
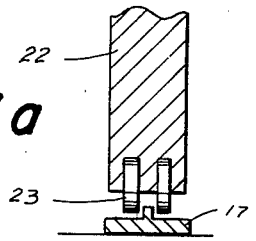
FIG. 3*a* is a fragmentary vertical section showing an intermediate support with its supporting roller and rail.
Figure 3B:
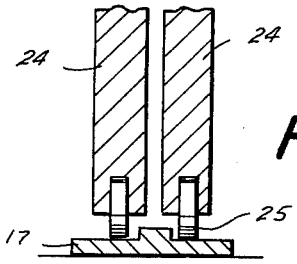
FIG. 3*b* is a view similar to FIG. 3*a* but illustrating still another variation having reinforced double vertical intermediate supports to the framework, each such support and its supporting roller resting on a common rail.
Figure 4:
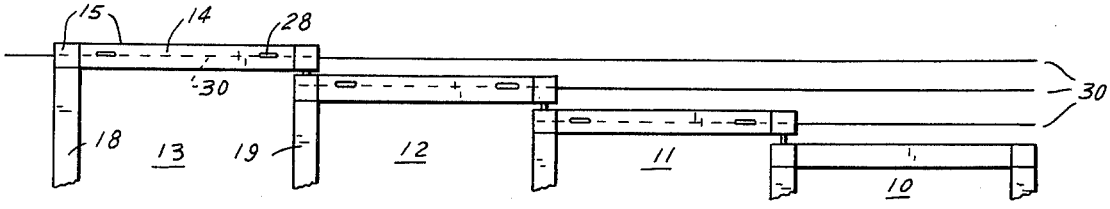
FIG. 4 is a fragmentary section through a sidewall of a telescopic building according to the invention, with an indication of the guiding and supporting rails, the rollers, and showing fragments of the front and rear supporting frames.

FIGS. 3*a* and 3*b* show two variations of the devices 22. In FIG. 3*a* there is shown a device 22 which is provided at its lower end with a pair of turnable rollers 23. These cooperate with a rail (or rails) which have not been shown but have been previously described with reference to the above-discussed figures. FIG. 3*b* shows a double support device 24 which is a variation of the device 22; it is composed of two sections each of which has a lower end provided with a roller 25 mounted on an anti-friction bearing (not shown). As in all embodiments, the rollers 25 are again adapted to cooperate with intermediate rail or rails 17.

Figure 6:
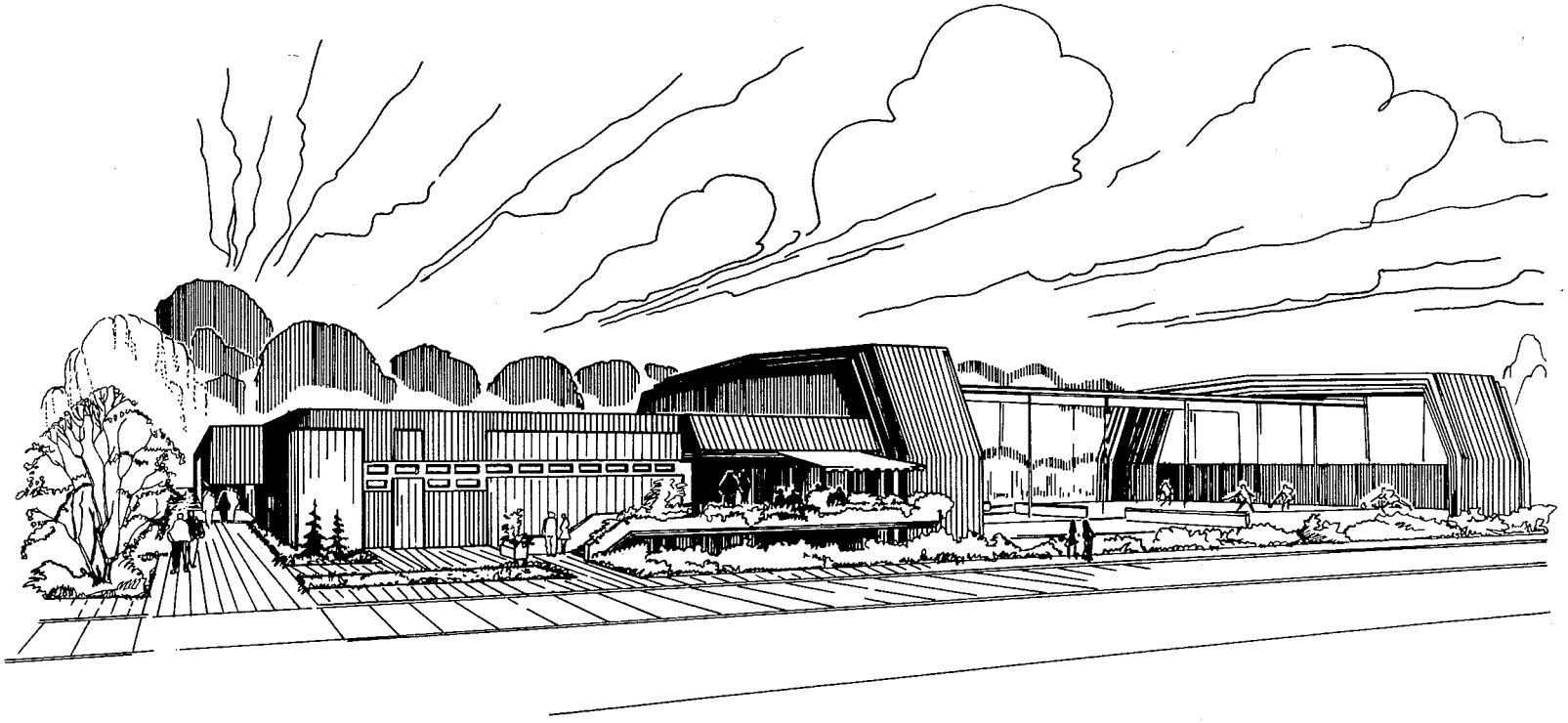
FIG. 6 is a perspective view, showing a building according to the present invention with the telescopic part thereof in retracted (i.e. open) position.

FIG. 6, finally, is a perspective view illustrating one possible use of the building according to the invention, namely as an enclosure for two or more tennis courts. The Figure shows the telescopic mobile roof and wall elements in retracted position, so that the interior of the building is exposed and, in effect, converted to "open-air" space. To re-enclose this space, for example in the event of inclement weather, it is merely necessary to extend the mobile elements from opposite ends of the building until they meet in the middle.

While the invention has, in compliance with the Statutes, been described with reference to examplary embodiments, it will be understood that no limitation to these embodiments is implied, inasmuch as changes and variations will offer themselves to those skilled in the art. Accordingly, the invention to be protected is defined exclusively in the appended claims.

I claim:

1. A telescoping building, comprising lateral and intermediate support means;

elongated ways on said lateral and intermediate support means and having longitudinally spaced end portions;

at least one stationary integral wall and roof element on said support means at each of said end portions and each having a predetermined height and width;

a set of movable integral wall and roof elements at each of said portions and having a progressively different height and width, all of said elements having respective base portions and each element at one end portion having an identically dimensioned counterpart element at the other end portion; and roller means provided on each said base portion in rolling engagement with said ways of said lateral and intermediate support means for movement and guidance of said movable elements relative to the respective stationary element to and from a telescoped- apart position, all elements at each end portion being movable towards the elements of the respective other end portions so as to meet the same substantially midway between said end portions; and at least the intermediate common rail for said movable elements extending between said end portions, such movable elements of each set including a front frame having at least one roller in engagement with said common rail, said common rail having a roller-engaging surface located at the same level as the surfaces of roof supports on said stationary element.

2. A telescopable building, comprising lateral and intermediate support means;

elongated ways on said lateral and intermediate support means and having longitudinally spaced end portions;

at least one stationary integral wall and roof element on said support means at each of said end portions and each having a predetermined height and width;

a set of movable integral wall and roof elements at each of said portions and having a progressively different height and width, all of said elements having respective base portions and each element at one end portion having an identically dimensioned counterpart element at the other end portion; and roller means provided on each said base portion in rolling engagement with said ways of said lateral and intermediate support means for movement and guidance of said movable elements relative to the respective stationary element to and from a telescoped-apart position, all elements at each end portion being movable towards the elements of the respective other end portion so as to meet the same substantially midway between said end portions; and at least the intermediate common rail for said movable elements extending between said end portions, such movable elements of each set including a front frame having at least one roller in engagement with said common rail, the height of the rolling surface of said intermediate common rail being equivalent to one of its extremities, at the height of the surface of the roof supports of said stationary element and for the third and fourth mobile elements the differences in height in relation to the adjacent element being compensatable by a corresponding raising of the level of said common rail.

* * * * *